US007506480B1

(12) United States Patent
Chandler

(10) Patent No.: US 7,506,480 B1
(45) Date of Patent: Mar. 24, 2009

(54) SYSTEM AND METHOD OF FORMING EXPANSION JOINTS

(76) Inventor: Rory A. Chandler, 2101 Main St., Bellevue, NE (US) 68005-5039

( * ) Notice: Subject to any disclaimer, the term of this patent is extended or adjusted under 35 U.S.C. 154(b) by 114 days.

(21) Appl. No.: 11/523,454

(22) Filed: Sep. 19, 2006

(51) Int. Cl.
*E04B 1/62* (2006.01)
*E04B 1/68* (2006.01)
*E04B 1/682* (2006.01)

(52) U.S. Cl. ..... 52/393; 52/396.01; 52/396.02; 52/396.03; 52/396.04; 52/396.05; 52/396.06; 52/396.07; 52/396.08; 52/396.09

(58) Field of Classification Search ..... 52/393, 52/396.01–396.09, 390; 404/47, 48, 49, 404/68; 14/73.1
See application file for complete search history.

(56) References Cited

U.S. PATENT DOCUMENTS 3,385,017 A * 5/1968 Williams ..... 52/378
3,395,507 A * 8/1968 Moody ..... 52/390
3,782,846 A * 1/1974 Johnson ..... 404/48
3,896,597 A * 7/1975 Deason ..... 52/396.02
4,346,542 A * 8/1982 Tateno ..... 52/396.02
4,815,886 A * 3/1989 Madsen ..... 403/28
4,841,704 A * 6/1989 Jarrell ..... 52/396.02
5,450,699 A * 9/1995 Lee ..... 52/396.02
6,293,066 B1 * 9/2001 Lohrey ..... 52/396.08
6,574,933 B1 * 6/2003 Devlin ..... 52/396.05
2002/0095895 A1 * 7/2002 Daly et al. ..... 52/464

* cited by examiner

*Primary Examiner*—Richard E Chilcot, Jr.
*Assistant Examiner*—Mark R Wendell
(74) *Attorney, Agent, or Firm*—Holland & Hart LLP

(57) ABSTRACT

A system and method are provided for forming expansion joints within artificial ground cover. An elongated expansion joint support is coupled with a length of expansion joint material. A lower end portion of the expansion joint support is shaped to engage a ground surface. The two structures may be coupled with one another in different positions to vary the resulting expansion joint height. The lower end portion of the expansion joint support may be shaped to have a ground engagement wall and to receive ground engagement spikes. No component parts need be removed from the system after the application of artificial ground cover adjacent thereto, thus permitting simultaneous application of ground cover on both sides of the expansion joint.

18 Claims, 4 Drawing Sheets

SYSTEM AND METHOD OF FORMING EXPANSION JOINTS

BACKGROUND

Expansion joints are commonly found in various forms of artificial ground cover, including concrete forms such as sidewalks, driveways and other slab structures. Expansion joints may also be used in other forms of ground cover that may be comprised of masonry, various metals, and other such materials that are prone to expansion and contraction throughout seasonal temperature changes. The expansion joints help to cushion the effect of expansion and contraction, thus preventing cracking, heaving and other such ill effects.

Expansion joints are typically formed from durable, resiliently deformable materials. Fiber-board is an example of one common expansion joint material which is formed from natural and man-made fibers that are bonded together using asphalt or other known bonding agents. Other expansion joint materials include closed-cell polyfoam, rubber, cork, cross-linked ethylene vinyl acetate and closed-cell neoprene. The expansion joint material selected may depend upon various factors presented in each particular application. Some factors may include cost, climate and type of material used in the formation of the artificial ground cover. Regardless of their construction, expansion joint materials are typically formed to have a thickness that ranges between ¼ of an inch to 1 inch. Common widths range from 3 inches to 12 inches and their lengths are commonly found in four to ten foot sheets.

Commonly, expansion joint material is positioned adjacent an existing section of ground cover, such as concrete, prior to applying new ground cover immediately adjacent thereto. In instances where expansion joint material is to be positioned in an area where no existing ground cover exists, contractors typically position ½"×4" or 1"×4" backboard behind the expansion joint material and stake the backboard in place. The new ground cover is then applied over the ground surface adjacent the expansion joint material. Once the ground cover has sufficiently cured, the backboard and stakes are removed and the next section of ground cover may be applied to the ground surface, adjacent the opposite side of the expansion material. This method of forming an expansion joint has several shortcomings. First, the ground cover is applied to the ground surface in multiple stages over a period of two or more days. The increased number of trips to and from a job-site become time consuming and expensive over time. Secondly, as depicted in FIG. 2, expansion joint material is frequently provided in widths that are insufficient to span the full thickness of the ground cover being applied. Accordingly, as the ground cover is applied to the ground surface adjacent the expansion joint material, the ground cover will not be segregated from adjacent, existing ground cover. This results in the two sections of ground cover being abutted immediately adjacent one another and defeats the purpose of installing an expansion joint at this location. In other instances, also depicted in FIG. 2, the ground surface is improperly prepared, leaving depressions or other recesses at the location where an expansion joint is required. In these instances, expansion joint material that would otherwise be of sufficient width for the thickness of ground cover being applied will be insufficient to span the distance from the bottom of the depression to the surface of the ground cover being applied. The result will produce a single section of ground cover without the appropriate expansion joint structure.

Accordingly, what is needed is a novel system and method for forming expansion joints that enables a user to prepare an entire site for a single pour or application of artificial ground cover. Such a novel system and method should also enable a user to vary the vertical positioning of expansion joint material in a given location while effectively segregating adjacent sections of ground cover.

SUMMARY

This Summary is provided to introduce a selection of concepts in a simplified form that are further described below in the Detailed Description. This Summary is not intended to identify key aspects or essential aspects of the claimed subject matter. Moreover, this Summary is not intended for use as an aid in determining the scope of the claimed subject matter.

A system and method are provided for forming at least one expansion joint in artificial ground cover. An elongated expansion joint support is provided with at least one outer surface, an upper end portion and a lower end portion. The lower end portion of the expansion joint support is shaped to operatively engage the ground surface. A length of expansion joint material, having an upper end portion and a lower end portion, is operatively coupled with the expansion joint support so that at least a portion of the upper end portion of the expansion joint material extends along but beyond the upper end portion of the expansion joint support. The lower end portion of the expansion joint support is then operatively coupled with the ground surface. Ground cover may then be applied over the ground surface closely adjacent the outer surface of the expansion joint support and the expansion joint material.

In one aspect of the invention, fasteners may be used to extend inwardly from the expansion joint support to secure the expansion joint material therewith. The expansion joint material may be secured with the expansion joint support at various positions along the width of the expansion joint support in order to selectively space the upper end portion of the expansion joint material from the upper end portion of the expansion joint support. In another aspect of the invention, a plurality of openings may be formed in the lower end portion of the expansion joint support so that spikes may be passed through the openings and into the ground surface to operatively secure the expansion joint support with the ground surface.

In another aspect of the invention, the lower end portion of the expansion joint support may be shaped to have a ground engagement wall that extends generally perpendicularly with respect to the remainder of the expansion joint support. The ground engagement wall may extend laterally beyond the sides of the expansion joint support to stabilize the same on the ground surface. The ground engagement wall may also terminate flush with a side of the expansion joint support to provide a close fit adjacent existing ground cover.

One preferred aspect of the invention provides the expansion joint support with a pair of generally parallel, spaced-apart support walls that extend upwardly from the lower end portion of the expansion joint support. The expansion joint material may be secured between the support walls of the expansion joint support.

It is therefore a principal object of the present invention to provide a system and method of forming expansion joints in artificial ground cover that permits non-staged, single application of ground cover material adjacent both sides of the expansion joint.

A further object of the present invention is to provide a system and method of forming expansion joints in artificial ground cover that permits a user to vary the height of an expansion joint while effectively segregating adjacent sections of ground cover.

Still another object of the present invention is to provide a system and method of forming expansion joints in artificial ground cover that effectively supports expansion joint material in place during the application of new ground cover to the ground surface.

Yet another object of the present invention is to provide a system and method of forming expansion joints in artificial ground cover that does not require the removal of support structure adjacent the expansion joint after the application of ground cover material adjacent the ground surface and the expansion joint material.

A further object of the present invention is to provide a system and method of forming expansion joints in artificial ground cover that is relatively simple and inexpensive to manufacture.

Still another object of the present invention is to provide a system and method of forming expansion joints in artificial ground cover that is relatively quick and simple to use.

These and other objects of the present invention will be apparent after consideration of the Detailed Description and Figures herein.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

DETAILED DESCRIPTION

Embodiments are described more fully below with reference to the accompanying figures, which form a part hereof and show, by way of illustration, specific exemplary embodiments. These embodiments are disclosed in sufficient detail to enable those skilled in the art to practice the invention. However, embodiments may be implemented in many different forms and should not be construed as being limited to the embodiments set forth herein. The following detailed description is, therefore, not to be taken in a limiting sense in that the scope of the present invention is defined only by the appended claims.

Figure 3:
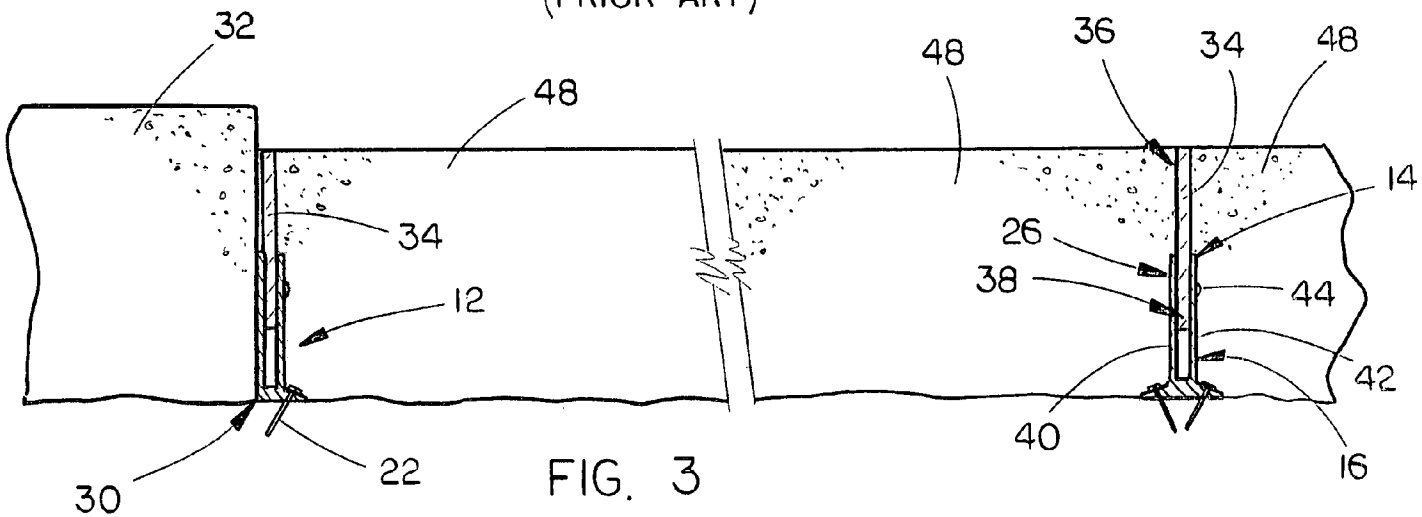
FIG. 3 depicts a side elevation view of one preferred expansion joint system as the same could be incorporated among different sections of artificial ground cover.
Figure 4:
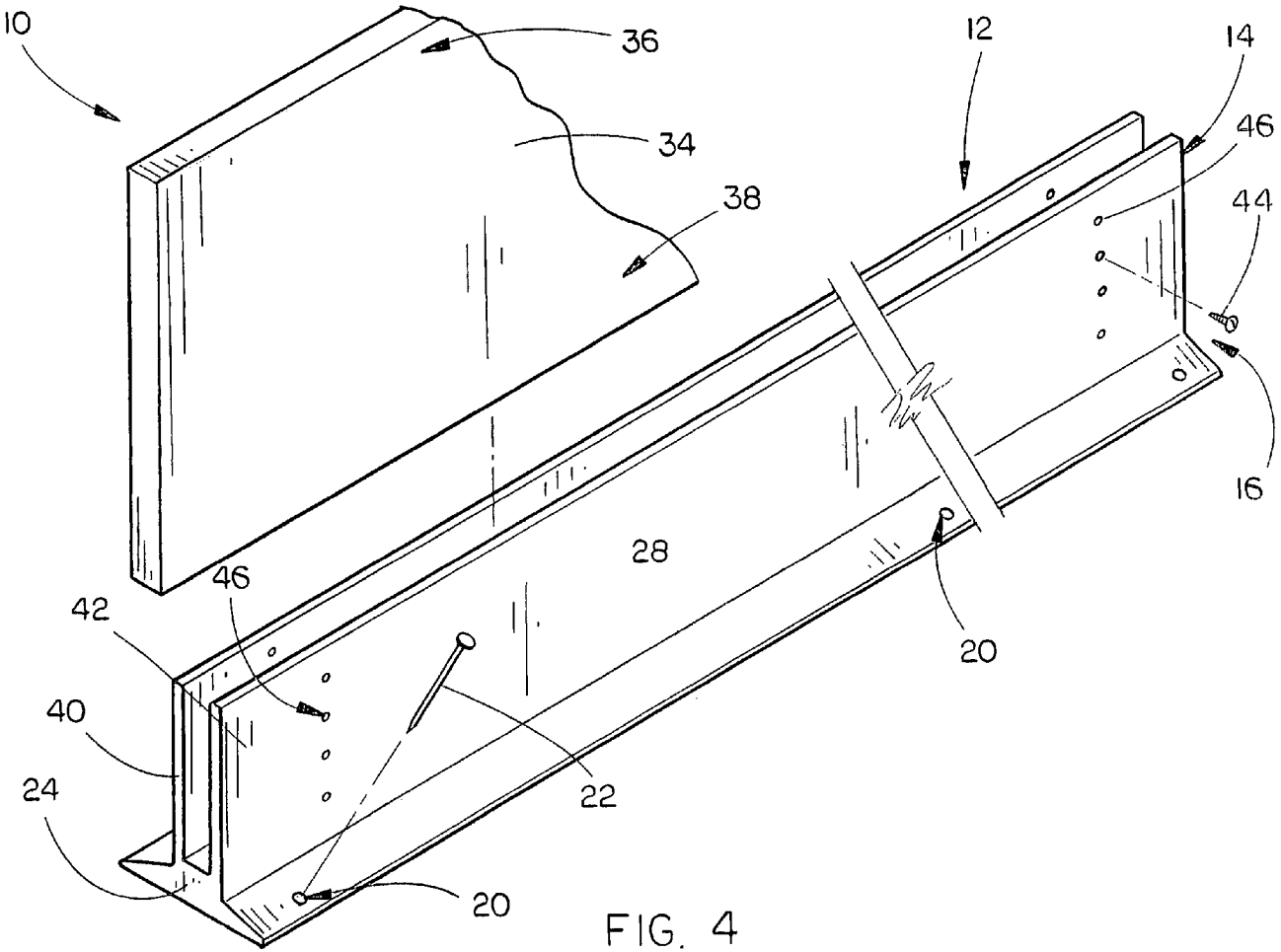
FIG. 4 depicts a partially exploded, isometric view of one preferred expansion joint system of the present invention.
Figure 5:
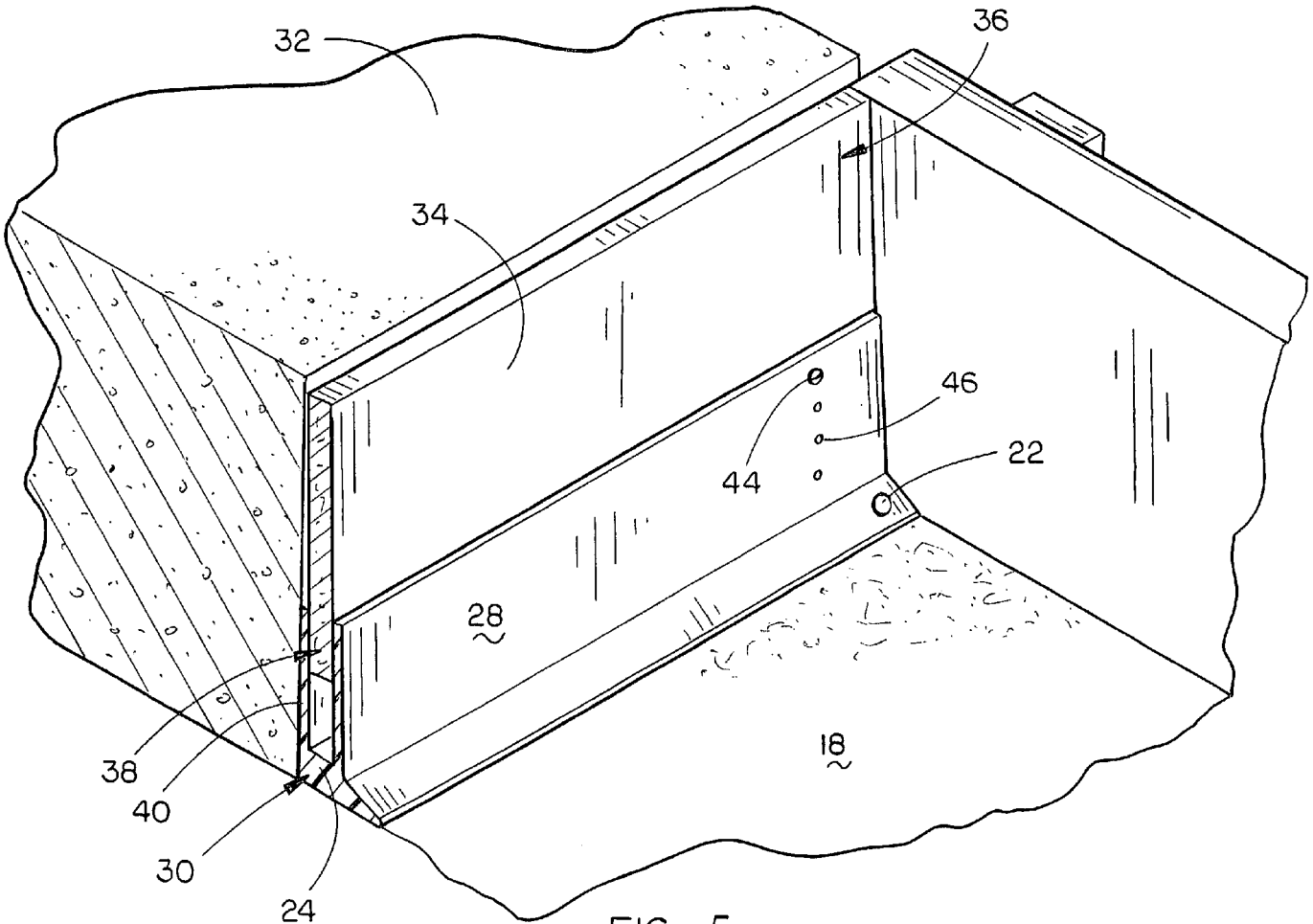
FIG. 5 depicts a sectional, isometric view of one preferred expansion joint system as the same could be used in preparing a ground surface to receive a section of artificial ground cover adjacent an existing section of artificial ground cover.

The expansion joint system 10 of the present invention is generally provided with an elongated expansion joint support 12, having an upper end portion 14 and a lower end portion 16. The lower end portion 16 is preferably shaped to operatively engage a ground surface 18. In one preferred embodiment, the lower end portion 16 is shaped to have a plurality of openings 20 that are spaced along the length of the expansion joint support 12. The openings 20 are shaped and sized to receive a plurality of spikes 22 (or other similar form of fastener) therethrough, such that the spikes 22 engage the ground surface 18 and secure the lower end portion 16 of the expansion joint support 12 thereto. FIGS. 3 and 4 depict possible configurations of the openings 20 and spikes 22 and at least one manner in which the same may be employed. In another preferred embodiment, the lower end portion 16 of the expansion joint support 12 is shaped to have a ground engagement wall 24 that extends generally perpendicularly with respect to the remainder of the expansion joint support 12. As depicted in FIG. 3, it is contemplated that the ground engagement wall 24 may extend outwardly from a first outer surface 26 and an opposite, second outer surface 28 of the expansion joint support 12. This arrangement provides the expansion joint support 12 with an increased degree of stability that permits the expansion joint support 12 to remain in an upright, free-standing position. However, FIG. 3 also depicts another preferred embodiment wherein the ground engagement wall 24 extends outwardly from only one of the outer surfaces of the expansion joint support 12, forming a lower corner portion 30, which may be positioned closely adjacent the ground surface 18 and the generally vertical face of an existing section of ground cover 32. As discussed in greater detail herein below, this arrangement permits the formation of an expansion joint closely adjacent the existing section of ground cover 32.

The expansion joint system 10 is further provided with a length of expansion joint material 34, having an upper end portion 36 and a lower end portion 38. It is contemplated that the expansion joint material 34 may be comprised of nearly any material suitable for use in forming expansion joints. Variation from one material to the next in forming the expansion joint material 34 will not greatly affect the use or performance of the expansion joint system 10 as the expansion joint system 10 is constructed to be adaptable for use in nearly any environment and with nearly any type of artificial ground cover.

Figure 2:
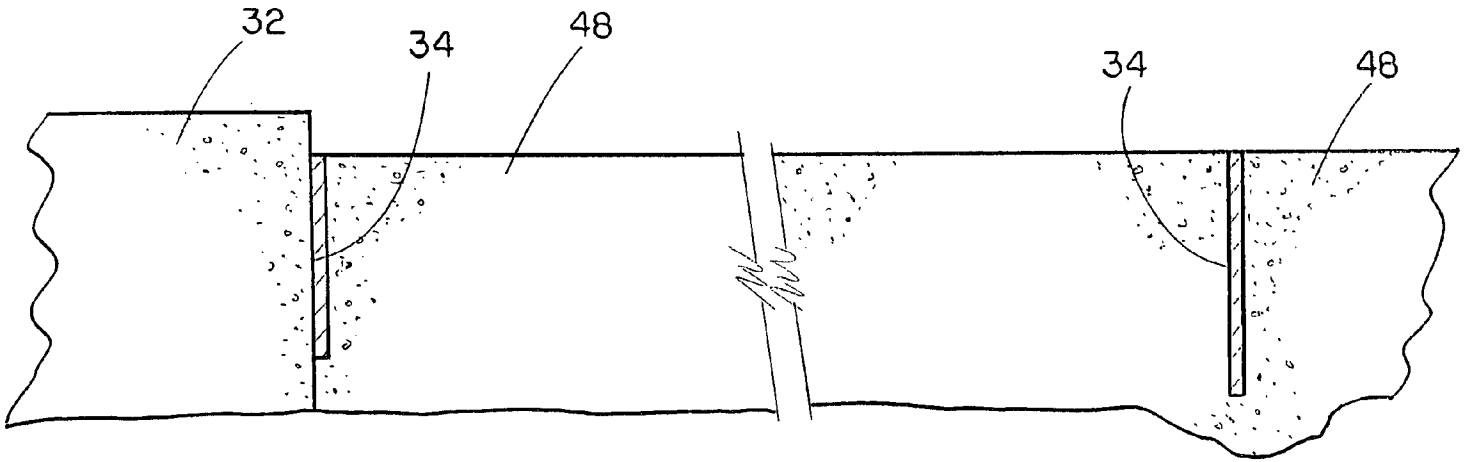
FIG. 2 (PRIOR ART)
FIG. 2 depicts improperly formed expansion joints that frequently occur when prior art systems and methods of forming expansion joints are implemented.

In use, the expansion joint support 12 is coupled with the expansion joint material 34 so that at least a portion of the upper end portion 36 of the expansion joint material 34 extends along but beyond the upper end portion 14 of the expansion joint support 12. FIG. 4 depicts one preferred embodiment of the expansion joint support 12 wherein a first support wall 40 and second support wall 42 extend upwardly from the lower end portion 16 of the expansion joint support 12 so that the first and second support walls 40 and 42 are positioned in a generally parallel, spaced-apart relationship with one another. This orientation permits at least the lower end portion 38 of the expansion joint material 34 to be received between the first support wall 40 and the second support wall 42. To that end, the first support wall 40 and second support wall 42 may be positioned to be spaced apart from one another by a distance that is slightly smaller than the thickness of the expansion joint material provided. This arrangement provides a degree of friction fit between the expansion joint material 34 and the expansion joint support 12, securing a user selected position of the two structures with respect to one another. Slightly biasing the upper end portions of the first support wall 40 and second support wall 42 would provide a similar effect. It is also contemplated that the expansion joint support 12 could be formed to have only one support wall extending upwardly from the lower end portion 16. Regardless of whether one or more support walls are provided, the expansion joint material 34 may be operatively secured with the expansion joint support 12 using a plurality of fasteners 44 that extend inwardly from at least one of the support walls in the expansion joint support 12. It is contemplated that the fasteners 44 may be provided in the form of integral teeth members or a plurality of separate fasteners 44 that are passed through openings 46 formed through at least one of the support walls of the expansion joint support 12. As depicted in FIG. 4, the openings 46 may be provided at different selectable positions between the upper end portion 14 and the lower end portion 16 of the expansion joint support 12. This will permit the upper end portion 36 of the expansion joint material 34 to be positioned at different heights relative to the upper end portion 14 of the expansion joint support 12, thus providing an expansion joint system 10 that is capable of being installed in various selectable heights according to the circumstances presented. For example, the instances depicted in FIG. 2 could easily be remedied by the expansion joint system 10, wherein the height of the expansion joint material 34 could be increased relative to the expansion joint support 12 so that the expansion joint system 10 would extend to the ground surface 18.

Figure 1:
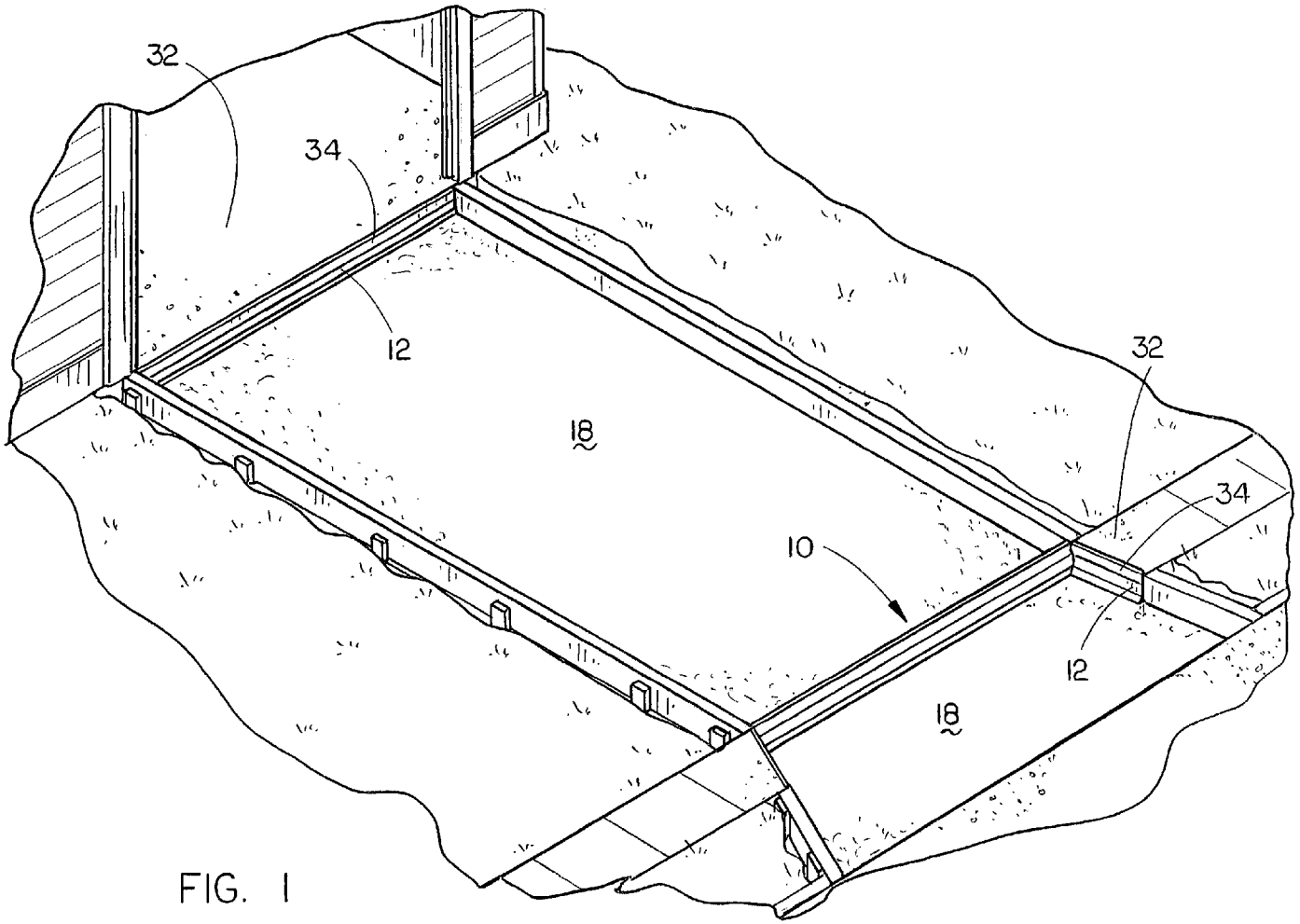
FIG. 1 depicts a perspective view of a driveway after the application of one preferred expansion joint system of the present invention but prior to the application of new ground cover material.

Once the expansion joint material 34 is coupled with the expansion joint support 12, the system 10 may be placed in position closely adjacent the ground surface 18. It will be desirable to position a length of the expansion joint system 10 closely adjacent any pre-existing ground surface sections 32, as depicted in FIG. 1. However, the expansion joint system 10 provides a level of flexibility that permits positioning of an expansion joint intermediate new sections of ground cover 48 that are to be installed in a single application or pour. In the example depicted in FIG. 1, wherein the chosen ground cover is concrete, the expansion joint system 10 permits the user to pour the driveway section and the approach section at one time.

Irrespective of whether the expansion joint system 10 is to be used adjacent existing sections of ground cover 32 or intermediate new sections of ground cover 48, it will simply be desirable to form a barrier that extends from the ground surface 18 to a point near the desired upper surface of the new section of ground cover 48. In this manner, the barrier formed by the expansion joint support 12 and the expansion joint material 34 substantially prevents the passage of new ground cover material past the expansion joint system 10. This will prevent the comingling of adjacent sections of ground cover and create the desired expansion joint. Accordingly, any openings formed through the expansion joint system 10, such as the openings 46, should be shaped and sized so that a minimal amount of ground cover material would enter or pass therethrough.

While it is contemplated that the expansion joint support 12 and other structures utilized within the expansion joint system 10 could be comprised of nearly any material, it is preferable to form each of the components from materials that may be left in position, beneath the surface of the ground cover, indefinitely. This will further reduce installation time by reducing the number of forms and other structural devices that are typically removed from the site once the ground cover has cured. However, it is contemplated that it may be desirable to form the expansion joint support 12 from a material that is at least slightly flexible, such that the expansion joint support 12 itself functions in a manner similar to the expansion joint material 34 by deforming slightly in response to the expansion of adjacent ground cover.

Although the invention has been described in language that is specific to certain structures and methodological steps, it is to be understood that the invention defined in the appended claims is not necessarily limited to the specific structures and/or steps described. Rather, the specific aspects and steps are described as forms of implementing the claimed invention. Since many embodiments of the invention can be practiced without departing from the spirit and scope of the invention, the invention resides in the claims hereinafter appended.

What is claimed is:

1. A method of forming at least one expansion joint adjacent artificial ground cover, the method comprising:

providing an elongated expansion joint support having at least one outer surface, an upper end portion and a lower end portion; said lower end portion being shaped to operatively engage a ground surface;

providing a length of expansion joint material having an upper end portion and a lower end portion;

operatively coupling said expansion joint support with said expansion joint material so that at least a portion of the upper end portion of said expansion joint material extends along but beyond the upper end portion of said expansion joint support;

operatively coupling the lower end portion of said expansion joint support with the ground surface such that the expansion joint support and expansion joint material form a barrier, which extends from the ground surface to the upper end portion of said expansion joint material along the lengths of the expansion joint support and expansion joint material, that substantially prevents the passage of flowable concrete past the expansion joint support and expansion joint material;

pouring flowable concrete over the ground surface, in contacting relationship with both the outer surface of said joint support and an outer surface of said expansion joint material.

2. The method of claim 1 wherein said expansion joint material is operatively coupled with said expansion joint support by a plurality of fasteners extending inwardly from said expansion joint support.

3. The method of claim 2 wherein said plurality of fasteners are passed through a plurality of openings formed through said expansion joint support.

4. The method of claim 1 further comprising:

forming a plurality of openings in the lower end portion of said expansion joint support; and operatively coupling the lower end portion of said expansion joint support with the ground surface by disposing a plurality of spikes through the plurality of openings formed in the lower end portion of said expansion joint support into the ground surface.

5. The method of claim 1 wherein the lower end portion of said expansion joint support is shaped to have a ground engagement wall with a length that is planar in shape and extends generally perpendicularly with respect to said expansion joint support, beneath the lower end portion of said expansion joint material.

6. The method of claim 5 wherein said expansion joint support is provided with a pair of generally parallel, spaced-apart support walls that extend upwardly from said ground engagement wall, terminating in a pair of distal ends that are covered after said flowable concrete is poured over said ground surface.

7. The method of claim 6 wherein said expansion joint material is positioned between said support walls.

8. The method of claim 7 wherein said expansion joint material is operatively coupled with said expansion joint support by a plurality of fasteners extending inwardly from at least one support wall in said expansion joint support.

9. The method of claim 7 further comprising:

forming a plurality of openings in the lower end portion of said expansion joint support; and operatively coupling the lower end portion of said expansion joint support with the ground surface by disposing a plurality of spikes through the plurality of openings formed in the lower end portion of said expansion joint support into the ground surface.

10. The method of claim 6 wherein said ground engagement wall extends outwardly from outer surfaces on both of said support walls.

11. The method of claim 6 wherein said ground engagement wall extends outwardly from an outer surface of only a first of said support walls.

12. The method of claim 1 wherein a second of said support walls forms a lower corner portion of said expansion joint support and said expansion joint support is operatively coupled with the ground surface so that an outer surface of said second support wall is positioned closely adjacent an existing section of ground cover, whereby said second support does not come into contact with said flowable concrete.

13. The method of claim 12 further comprising:

forming a plurality of openings in the lower end portion of said expansion joint support; and operatively coupling the lower end portion of said expansion joint support with the ground surface by disposing a plurality of spikes through the plurality of openings formed in the lower end portion of said expansion joint support into the ground surface.

14. The method of claim 13 wherein said expansion joint material is operatively coupled with said expansion joint support by a plurality of fasteners extending inwardly from at least one support wall in said expansion joint support.

15. The method of claim 1 wherein said expansion joint material is selectively engagable at different points with said expansion joint support such that the upper end portion of said expansion joint material is selectively vertically positionable with respect to the upper end portion of said expansion joint support.

16. The method of claim 15 wherein said expansion joint material is operatively coupled with said expansion joint support at one or more points along said expansion joint support such that a total joint height is created that extends between the lower end portion of said expansion joint support and the upper end portion of said expansion joint material that approximates a total desired height of said concrete above the ground surface.

17. The method of claim 1 wherein said expansion joint support and said expansion joint material define a first expansion joint and a second expansion joint support and a second length of expansion joint material are coupled with one another to define a second expansion joint; the first expansion joint and second expansion joint being positioned in a horizontally spaced-apart relationship with one another; the flowable concrete being poured between the first expansion joint and second expansion joint and left to cure into a single concrete section, bound on at least two sides by expansion joints.

18. The method of claim 17 wherein said flowable concrete is poured over the ground surface in a substantially uncured state; an initial amount of concrete is first applied over the ground surface adjacent one side of the expansion joint and an additional mount of concrete is applied over the ground surface adjacent an opposite side of the expansion joint prior to significant curing of the initial amount of concrete occurring.

* * * * *

UNITED STATES PATENT AND TRADEMARK OFFICE

CERTIFICATE OF CORRECTION

PATENT NO. : 7,506,480 B1
APPLICATION NO. : 11/523454
DATED : March 24, 2009
INVENTOR(S) : Rory A. Chandler It is certified that error appears in the above-identified patent and that said Letters Patent is hereby corrected as shown below:

In Column 7; Line 10, please delete “1” and insert --11--.

Signed and Sealed this

Twelfth Day of May, 2009

JOHN DOLL
*Acting Director of the United States Patent and Trademark Office*